US005354052A

United States Patent [19]

Nicholls et al.

[11] Patent Number: 5,354,052

[45] Date of Patent: Oct. 11, 1994

[54] HOLE-IN-ONE DETECTOR

[75] Inventors: David Nicholls, 2 Cromwell Street, Burwood, Victoria 3125; Glenn D. Pywell, Burwood, both of Australia

[73] Assignee: David Nicholls, Victoria, Australia

[21] Appl. No.: 32,980

[22] Filed: Mar. 18, 1993

[30] Foreign Application Priority Data

Mar. 26, 1992 [AU] Australia ..... PL1536

[51] Int. Cl.[5] ..... A63B 57/00; A63B 69/36

[52] U.S. Cl. ..... 273/34 R; 273/32 R; 273/183.1; 273/181 H

[58] Field of Search ..... 273/32 R, 34 R, 177 R, 273/34 A, 181 H, 183.1; 116/173

[56] References Cited

U.S. PATENT DOCUMENTS

| | | | |
|---|---|---|---|
| 4,133,534 | 1/1979 | Ikemoto | 273/176 E |
| 4,270,751 | 6/1981 | Lowy | 273/34 R |
| 4,437,672 | 3/1984 | Armantrout et al. | 273/185 B |
| 4,922,222 | 5/1990 | Baker | 273/34 R |

*Primary Examiner*—Jessica J. Harrison

*Attorney, Agent, or Firm*—Andrus, Sceales, Starke & Sawall

[57] ABSTRACT

A device for detecting the presence of a golf ball G in a ball-receiving cup comprising a flag pole 1 having a tubular lower portion 2 dimensioned to be received within a standard ball-receiving cup C and supporting four photointerruptors each comprising an infrared emitter 5 and a corresponding photodetector 5A, with the beams from the emitters 5 passing through opening 6 in the tubular portion 2 and being spaced at 90° intervals around the periphery of the tubular portion 2 so that the four quadrants of the cup C are within the fields of the photointerruptors. When a golf ball G enters the cup C, the infrared beam from one of the emitters 5 is reflected from the surface of the golf ball G and i s received by the corresponding photodetector to cause a change in the state of the photodetector which in turn causes a display 3 to be illuminated to indicate that a golf ball G has ended the cup C.

7 Claims, 3 Drawing Sheets

HOLE-IN-ONE DETECTOR

FIELD OF THE INVENTION

This invention relates to devices for detecting the presence of golf balls in golf cups and for generating a visual or audible indication of that presence.

BACKGROUND OF THE INVENTION

Hole-In-One competitions and golf driving ranges are becoming an increasingly popular form of recreation. In the case of Hole-In-One competitions, or practise ranges which reward a player for scoring a hole-in-one, it is important for the operator of the competition or practise range to have a means which positively detects the presence of a golf ball in a cup without the need for the operator to visually inspect the cup.

The patent literature discloses a number of devices for detecting the presence of a golf ball in a cup. Such detectors range from mechanical switches installed in the cup (U.S. Pat. Nos. 4,270,751 and 4,922,222) to photoelectric or electromagnetic detectors installed in the cup (U.S. Pat. No. 4,133,534) for sensing the presence of a ball in the cup and for generating an audible or visual alarm when detection occurs.

Each of the detection devices thus far proposed suffers from at least one serious disadvantage. The most serious disadvantage is that the detectors will not operate properly if a golf flag pole is installed in the cup. In the case of the mechanical switches, the ball will not necessarily lodge in the cup in a position to activate the switch. In the case of the photoelectric detector, the presence of the flag pole in the cup would break the photoelectric beam thereby setting off the alarm and rendering the detector useless.

Standard golf cups are divided by internal ribs into four quadrants, and when a flag pole is installed in the hole, the ball may drop into any one of the quandrants. None of the devices briefly outlined above function to securely detect the presence of the golf ball in a standard cup with a flag pole lodged in the cup.

SUMMARY OF INVENTION AND OBJECT

It is an object of the present invention to provide an improved device for detecting the presence of a qolf ball in a golf cup with a flag pole installed in the cup.

The invention therefore provides a device for detecting the presence of a golf ball in a ball-receiving cup, comprising a multiplicity of photoemitters and corresponding photodetectors arranged in use in predetermined positions in the cup with respective fields of operation which ensure that the detection beam from each photoemitter is reflected off a golf ball lodged in the cup and received by one of the photodetectors irrespective of the position of the ball in the cup, and circuit means for utilising the activation of the photodetector receiving the reflected beam to cause a visual and/or audible display or alarm to be activated.

While it is within the scope of the present invention for the multiplicity of photoemitters and corresponding detectors to be installed within the cup itself, it is recognised that such installation involves some inconvenience in that the cup must be suitably modified. It is therefore preferred that the multiplicity of photoemitters and corresponding photodetectors be installed in a lower portion of a golf flag pole such that the detection beams are emitted radially from the flag pole into the cup when the flag pole is installed in the cup.

The special golf flag pole also preferably carries a display or alarm means which is visible and audible from a distance so that the golfer and the operator are made aware that a golf ball has entered the cup.

The display preferably comprises a vertically spaced series of high intensity light emitting diodes or similar devices which are preferably controlled to illuminate in turn from the uppermost LED to the lowermost LED in a running light display. The flag pole preferably carries the necessary electronic circuitry and power source within a sealed chamber and the photoemitters and photodetectors are similarly installed in the flag pole in a manner which prevents their deterioration by bad weather or by rough handling.

In a particularly preferred embodiment of the invention, there are at least four photoemitters and four corresponding photodetectors, and the photodetectors are preferably capacitively coupled such that if any or all detectors receive light caused by sunlight/floodlight entering the cup, their capacitors may be fully charged. When a ball enters a cup, one of the four detectors will be momentarily blocked from the sunlight and its associated capacitor will discharge causing an imbalance in the circuit which is used to trigger the running light display or other indicator/alarm. In this way, the practical problem of a bright sunny day causing saturation of the photodetectors whereby they are rendered insensitive is overcome in a simple and effective manner.

BRIEF DESCRIPTION OF THE DRAWINGS

A presently preferred embodiment of the invention will now be described with reference to the accompanying drawings in which.

DESCRIPTION OF PREFERRED EMBODIMENT

Figure 1A:
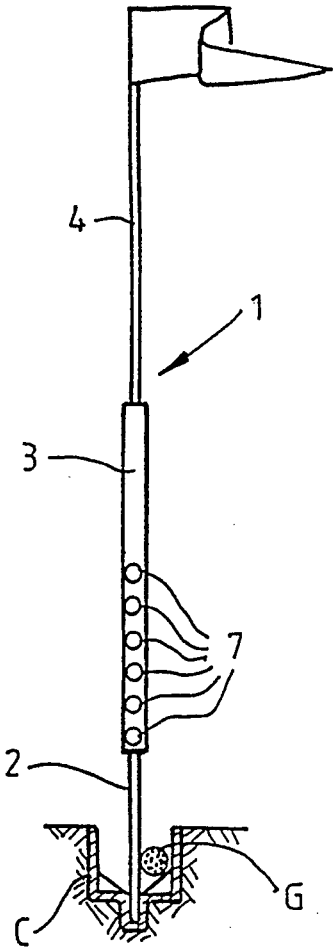
FIGS. 1A and 1B are a schematic representation of the device embodying the invention installed in a golf flag pole.
Figure 1B:
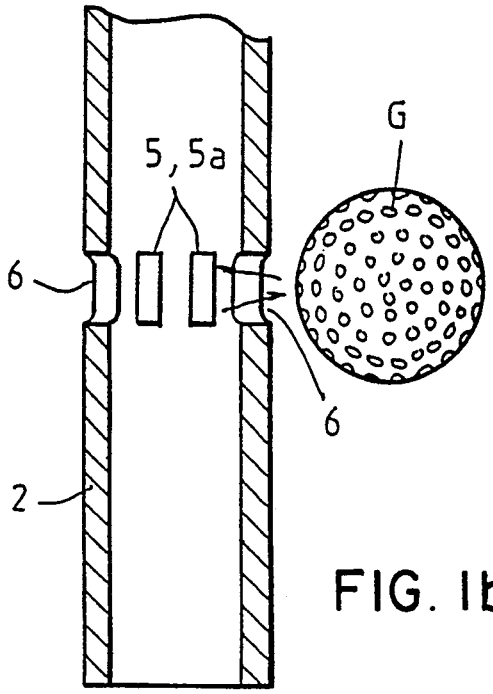

Referring firstly to FIG. 1 of the drawings, the preferred golf ball detector comprises a specially constructed flag pole 1 having a tubular lower portion 2, a central display portion 3 and an upper flag supporting portion 4. The lower tubular portion 2 is dimensioned to be received within a standard golf cup C in the usual manner, the golf cup C having the usual internal ribs (not shown) which effectively divide the cup into four quandrants.

The tubular lower portion 2 of the flag pole 1 supports four known photointerruptors, each comprising an infrared emitter 5 and a corresponding photodetector **5*a*, each of well known construction which requires no further description. The beams from the emitters 5 pass through openings 6 in the tubular portion 2, the openings 6 being spaced at 90° intervals around the periphery of the tubular portion 2 so that all four quandrants of the cup C are covered by the four photoemitters and corresponding detectors. Thus, when a golf ball G enters the cup C, the infrared beam from one of the emitters 5 will be reflected from the surface of the golf ball to be received by the corresponding photodetector 5*a*, and the change in state of the photodetector 5*a* is utilised to generate a display in the manner to be described further below. To avoid reflection of the infrared beams from the emitters 5** from the side walls of the cup C, the side walls may be painted matt black.

The display section 3 of the flag 1 is also tubular and carries six high intensity light emitting diodes 7 in a vertically spaced array as shown in FIG. 1. The display section 3 also houses electronic circuit means (FIGS. 2 and 3) and a power source for the circuit means comprising batteries mounted within a battery chamber (not shown) within the display section 3. The circuit means is arranged to cause a running display of the light emitting diodes 7 when the presence of a golf ball G is detected in the cup C.

Figure 2:
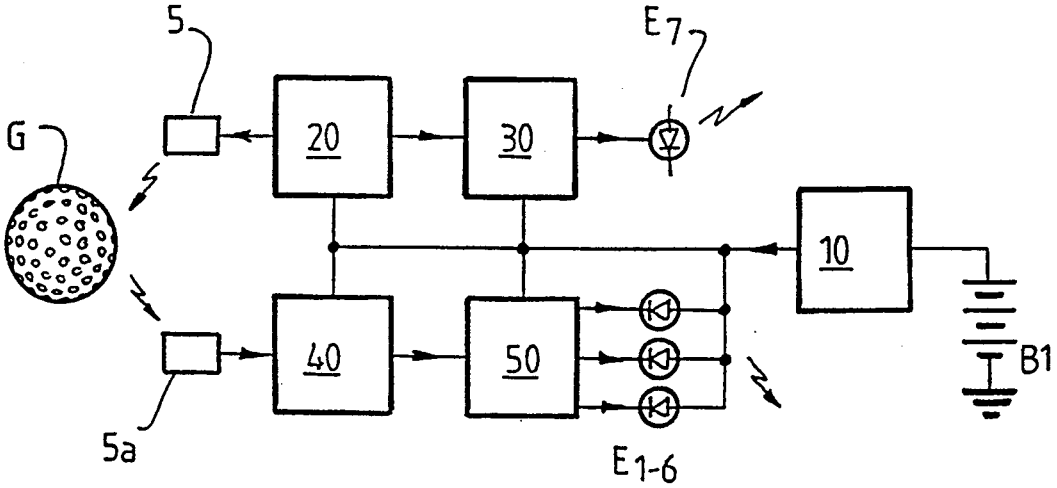
FIG. 2 is a block schematic diagram of the electronic circuitry installed in the flag pole.
Figure 3A:
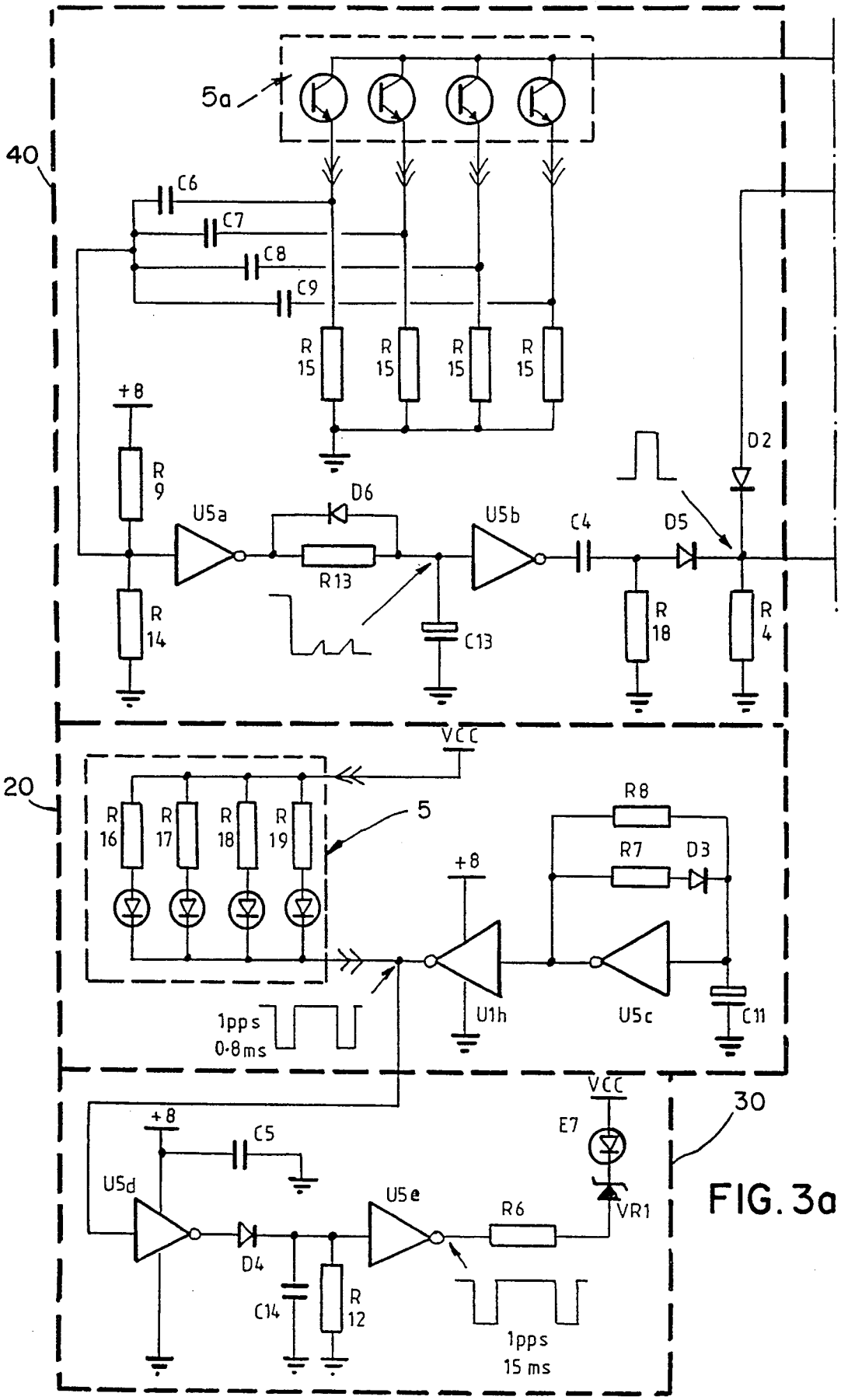
FIGS. 3A and 3B are a more detailed circuit diagram of the electronic circuitry installed in the flag pole.
Figure 3B:
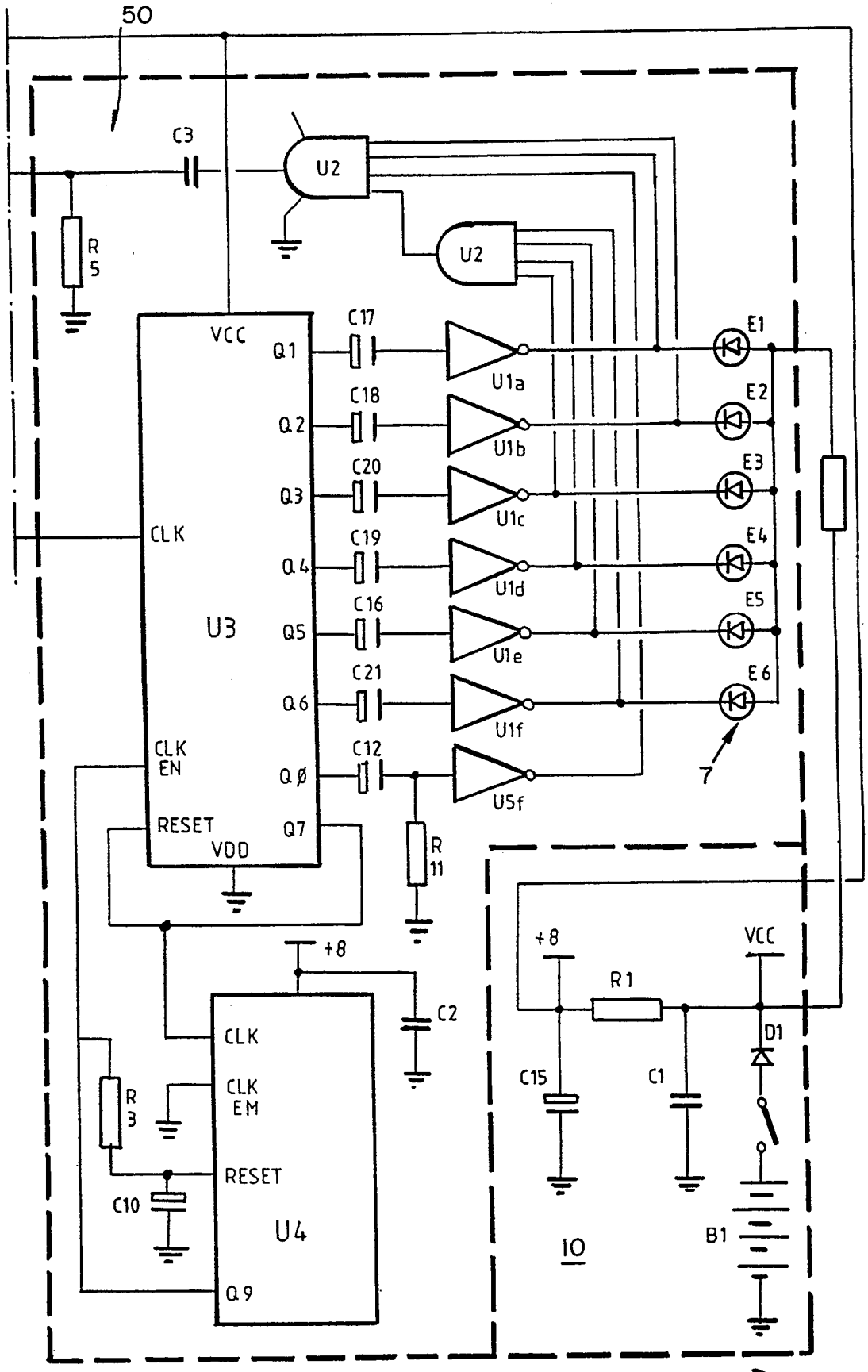

Referring now to FIGS. 2 and 3 of the drawings, the electronic circuitry installed in the display section 3 comprises a power supply 10 connected to the batteries B1 installed in the battery chamber and providing power to the remaining circuitry comprising a driver circuit 20 for the photoemitters 5, a low power detector 30 having an associated light emitting diode E, which is illuminated when the voltage at the power supply circuit 10 is lower than a predetermined value, a schmitt trigger circuit 40 adapted to be triggered by the photodetectors, and which in turn triggers a decade counter circuit 50 which is connected to sequentially drive the high intensity LEDs 7 (labelled E 1 to E 6) to cause the running light display referred to above.

The circuitry broadly described above is shown in greater detail in FIG. 3 of the drawings in which the reference numerals used above indicate the circuit block shown in FIG. 2 of the drawings. Thus, the power supply circuit 10 will be seen to comprise a nine volt battery source B1 comprising six 1.5 volt cells, a reverse voltage protection diode D1 and voltage regulation circuity C1, R1 and C15.

The driving circuit 20 comprises a pulse generating circuit including C11, R8, R7, D3 and U5*c* for driving the four photoemitters 5 to produce infrared pulses at one second intervals.

The battery low detector 30 increases the width of the pulses produced by the driver 20 from 0.8 millisecond to 15 milliseconds to cause a green LED to flash for 15 milliseconds each second. When the voltage rail VCC drops to approximately 7 volts, the brightness of the LED will be consideratly diminished thereby warning the operator to change the batteries. Due to the low current design of the circuit of FIG. 3, the estimated battery life using long life Alkaline batteries should be about 2000 hours.

The schmitt trigger circuit 40 comprises a schmitt trigger U5*a*, the output of which is connected to U5*b* to produce a positive leading edge pulse via C4 and a steering diode D5 to a decade counter U3. When a light pulse is received by one of the photodetectors 5*a* the output from the schmitt trigger U5*a* drops abruptly to generate the pulse referred to above. While a golf ball G remains in place, a continuous stream of pulses are produced, and since this would keep re-triggering the decade counter U3, a filter comprising R13, C13 and D6 allows only one trigger pulse to occur provided the continuous input pulse rate is more than one per 1.5 seconds.

The decade counter circuit 50 comprises decade counters U3/4 and LED drivers Ul*a* to Ul*f*. Once the decade counters U3/4 are initiated by U5*b*, they continue to self-clock thereby driving the light emitting diodes 7 (E1 to E6). As each light emitting diode 7, starting with E1, is driven on, the AND gate U2 produces the next clock pulse via C3 and the steering diode D2 into the decade counter U3 until output Q7 of U3 carries forward to U4. When Q9 (u4) outputs, it resets U4 and the running display stops. When the ball is removed, the filter R13, C13 and D6 recharges due to the lack of pulses until the next ball entry reinitiates the chain of events described above.

It will be noted in FIG. 3 that the four photodetectors 5*a* are capacitively coupled so that the only voltage present at the schmitt trigger U5*a* is the bias voltage set by R9/R14. When the photodetectors 5*a* are exposed to high brightness, such as may occur on a sunny day with the sun directly overhead, the capacitors C6 to C9 coupling the photodetectors 5*a* may be fully charged by the low resistance of their respective detectors, but when a ball enters the cup, one of the four detectors will be momentarily blocked from the external light source, during which period the related capacitor will discharge via R14 and R15 just prior to receiving reflected light pulses from the associated photoemitter 5 which causes recharging of the capacitor and impresses a voltage on the biased input of the schmitt trigger circuit thereby triggering the operation of the LED drivers to cause running illumination of the display 7. In this way, "false alarms" are inhibited while the presence of the golf ball in the cup is still able to be detected notwithstanding the presence of high brightness caused by overhead sun light.

We claim:

1. A device for detecting the presence of a golf ball in a ball-receiving cup, said cup also receiving a lower portion of a flag pole, comprising a multiplicity of photoemitters and corresponding photodetectors mounted in or on said lower portion of said flag pole whereby detection beams are emitted from each photoemitter substantially radially from the flag pole lower portion into the cup to ensure that the detection beam from a photoemitter is reflected off a golf ball lodged in the cup and is received by one of the photodetectors irrespective of the position of the ball in the cup, and circuit means for causing a visual and/or audible display or alarm to be activated in response to the receipt of the reflected beam by said one of the photodetectors.

2. The device of claim 1 wherein said flag pole also outputs said visual and/or audible display or alarm.

3. The device of claim 2, wherein said display includes a vertically spaced series of light emitting devices controlled to be illuminated in turn when the presence of a ball is detected.

4. The device of claim 1, wherein there are four photoemitters and corresponding photodetectors each having a field of operation which substantially includes one quadrant of the cup.

5. The device of claim 4 wherein said flag pole also outputs said visual and/or audible display or alarm.

6. The device of claim 4, wherein said photodetectors are coupled by capacitors which are changed in the presence of ambient light, the presence of a ball in the cup being detected by the ball blocking the ambient light from one of the detectors allowing the associated capacitor to discharge to enable detection of the ball to occur whilst preventing false alarms caused by ambient light.

7. The device of claim 6 wherein said flag pole also outputs said visual and/or audible display or alarm.

* * * * *